US006704965B2

(12) United States Patent
Ale et al.

(10) Patent No.: US 6,704,965 B2
(45) Date of Patent: Mar. 16, 2004

(54) TOOTHBRUSH WITH REMOVABLE BRUSHING MEMBERS

(76) Inventors: Hasan Al Ale, 694 Chemeketa Dr., San Jose, CA (US) 95123; Ala Ali, 694 Chemeketa Dr., San Jose, CA (US) 95123

( * ) Notice: Subject to any disclaimer, the term of this patent is extended or adjusted under 35 U.S.C. 154(b) by 96 days.

(21) Appl. No.: 10/047,736

(22) Filed: Oct. 22, 2001

(65) Prior Publication Data

US 2003/0074755 A1 Apr. 24, 2003

(51) Int. Cl.[7] ..... A46B 7/04; A46B 9/04
(52) U.S. Cl. ..... 15/167.1; 15/176.4; 15/202
(58) Field of Search ..... 15/167.1, 194, 15/201, 202, 176.1, 176.4–176.6, 210.1

(56) References Cited

U.S. PATENT DOCUMENTS

| | | | | | |
|---|---|---|---|---|---|
| 824,087 | A | * | 6/1906 | Babcock | 15/167.1 X |
| 846,900 | A | * | 3/1907 | Bloom | 15/176.4 |
| 1,378,157 | A | * | 5/1921 | Webster | 15/210.1 |
| 2,251,853 | A | * | 8/1941 | Pandiyan | 15/176.4 X |
| 2,545,814 | A | * | 3/1951 | Kempster | 15/167.1 X |
| 2,618,003 | A | * | 11/1952 | Robey | 15/176.4 |
| 3,879,791 | A | * | 4/1975 | Isler | 15/167.1 |
| 4,890,349 | A | * | 1/1990 | Nitzsche | 15/167.1 |
| 5,242,235 | A | * | 9/1993 | Li | 15/167.1 X |
| 5,412,831 | A | * | 5/1995 | Mongelluzzo | 15/167.1 |
| 6,145,152 | A | | 11/2000 | Ward | 15/176.1 |

FOREIGN PATENT DOCUMENTS

| | | | | |
|---|---|---|---|---|
| CH | 376472 | * | 5/1964 | 15/202 |
| DE | 445318 | * | 6/1927 | 15/167.1 |
| GB | 23951 | * | 10/1910 | 15/202 |
| GB | 358966 | * | 4/1930 | 15/176.4 |
| JP | 6-304022 | * | 11/1994 | 15/167.1 |

* cited by examiner

*Primary Examiner*—Mark Spisich
(74) *Attorney, Agent, or Firm*—Patent Law Group LLP; Carmen C. Cook

(57) ABSTRACT

A toothbrush with removable brushing members includes a handle, a brush head extending from the handle, and a first brushing member of soft wood. The brush head includes a bottom surface and a body together defining a cavity for receiving the first brushing member. The brush head further includes an anchoring member extending partially around the inside perimeter of the body except at a first end of the inside perimeter of the body. The first brushing member is inserted into the cavity at the first end and is slid along the cavity into the anchoring member. The anchoring member compresses against and bites into the sides of the first brushing member to secure the first brushing member in the cavity. The toothbrush can include multiple brushing members. In one embodiment, the brushing members are stubs made of siwak sticks so that effective dental cleaning can be carried out using siwak.

22 Claims, 12 Drawing Sheets

14
16a

16b 16c
16d 16a
16b
16c
16d
12

TOOTHBRUSH WITH REMOVABLE BRUSHING MEMBERS

BACKGROUND OF THE INVENTION

1. Field of the Invention

This invention relates to toothbrushes, and in particular to a toothbrush with removable brushing members.

2. Description of the Related Art

Toothbrushes are commonly manufactured including a handle and a brush head where the brush head holds bristles or tufts of bristles suitable for cleaning teeth. Typically, the bristles are moved against the teeth in a sawing motion to remove plaque and other materials. When the bristles wear or become too soft to be able to use for cleaning effectively, the toothbrush is discarded and replaced with a new toothbrush. This practice is wasteful as the bristles typically wear out long before the handle or the brush head of the toothbrush will. U.S. Pat. No. 6,145,152 discloses a toothbrush with a replaceable head construction. In such a toothbrush, the head of the toothbrush can be replaced without replacing the brush handle. Nonetheless, an individual has to purchase a new brush head when only the bristles are wore out.

In some countries, toothbrushes are not commonly used and other means for dental cleaning are employed. For example, in Saudi Arabia, a piece of soft wood, commonly known as sywack, is used by an individual to clean the teeth. Sywack, also referred to as siwak or sewak, is a soft wood containing fine fibers running along the length of the wood. The user holds a sywack stick in a hand and rubs an end of the stick against the teeth for cleaning the surface of the teeth. Unfortunately, when the sywack stick is used, only the front surface of the front teeth (i.e., the incisors and the canines) can be directly approached by the end of the sywack stick. The side and back teeth (i.e., the bicuspids and the molars) and the inside surface of the front teeth receive less cleaning because of the difficulties in placing the cleaning surface of the sywack stick adjacent to these areas. Accordingly, a solution is needed to allow a user to use sywack in a way that will effectively clean all tooth surfaces of both the front and the back teeth in an individual.

SUMMARY OF THE INVENTION

According to the present invention, a toothbrush with removable brushing members is disclosed. The toothbrush includes a handle, a brush head extending from the handle, and a first brushing member of soft wood. The brush head includes a bottom surface and a body together defining a cavity for receiving the first brushing member. The brush head further includes an anchoring member extending partially around the inside perimeter of the body except at a first end of the inside perimeter of the body. The first brushing member is inserted into the cavity at the first end and is slid along the cavity into the anchoring member. The anchoring member compresses against and bites into the sides of the first brushing member to secure the first brushing member in the cavity. In one embodiment, the toothbrush includes multiple brushing members.

In one embodiment, the brushing members are stubs made of siwak sticks. A siwak stick can be cut into stubs of a desired height and assembled into the toothbrush of the present invention so that effective dental cleaning can be carried out using siwak.

DETAILED DESCRIPTION OF THE PREFERRED EMBODIMENTS

While certain embodiments of this invention will be described, it should be understood that this description is illustrative only and not limiting. Other embodiments of this invention will be obvious in view of the following disclosure.

Figure 1:
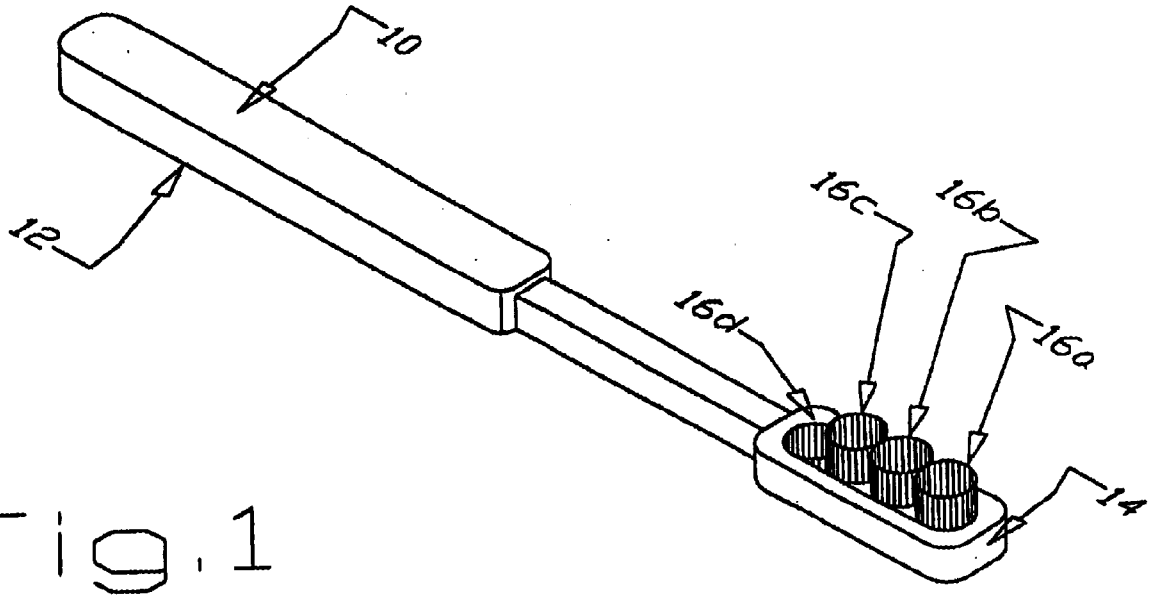
FIG. 1 is a perspective view of a toothbrush with removable brushing members according to one embodiment of the present invention.

FIG. 1 is a perspective view of a toothbrush 10 with removable brushing members according to one embodiment of the present invention. In accordance with the present invention, fully assembled toothbrush 10 includes removable and disposable brushing members 16*a*–16*c* which are inserted into the toothbrush during assembly. The brushing members are replaced when the bristles of the brushing members become worn out or too soft for effective cleaning. In this manner, the useful life of toothbrush 10 can be extended to provide a cost effective toothbrush.

Figure 2:
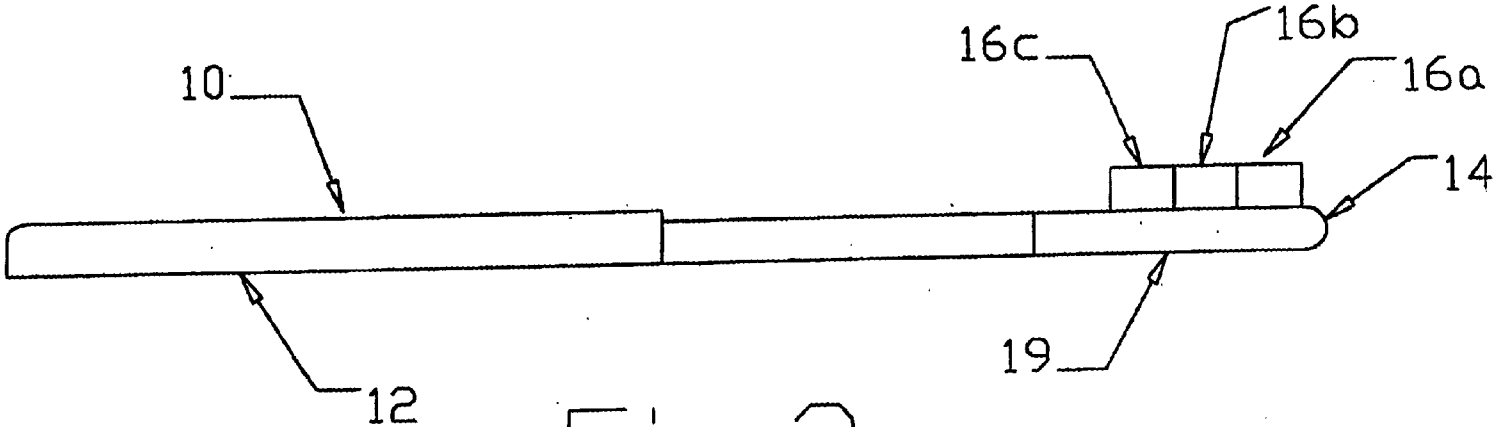
FIG. 2 is a side view of the toothbrush of FIG. 1.

Referring to FIG. 1, toothbrush 10 includes a handle 12 and a brush head 14 extending from handler 12. Brush head 14 includes an elongated cavity for securing one or more brushing members in the cavity. The cavity can be provided with different dimensions for receiving brushing members having different diameters. In the present embodiment, the cavity has a width suitable for accommodating one brushing members and a length suitable for accommodating three brushing members 16*a*–16*c* and a locking member 16*d*, arranged linearly along the length of the cavity of brush head 14. In the present embodiment, locking member 16*d* is used to hold brushing members 16*a*–16*c* affixed in cavity 20 and locking member 16*d* has a height shorter than brushing members 16*a*–16*c*. Of course, in other embodiments, locking member 16*d* can have the same height as the brushing members and thus, locking member 16*d* also functions as a brushing member. FIG. 2 illustrates a side view of toothbrush 10 illustrating the relative height of brushing members 16*a*–16*c* to locking member 16*d* in the present embodiment. The distal ends of brushing members 16*a*–16*c* are the cleaning surfaces for used in brushing against the teeth of a user.

Brushing members 16*a*–16*c* are typically cylindrical in shape and can be made of any material that is soft and suitable for brushing against the teeth. In the preferred embodiment of the present invention, brushing members 16*a*–16*c* are made of the soft wood sywack (also called siwak). Sywack or siwak is preferable as it is a natural material and is low cost. Sywack has been known to be effective for cleaning teeth as sywack contains fine fibers which fibers can be softened when wet. Furthermore, sywack contains a powder which is also known to be effective in teeth cleaning and in promoting healthy gum. In another embodiment, the brushing members can be made of bristles of nylon filaments, as will be described in more detail below.

In accordance with the preferred embodiment of the present invention, a piece of sywack is cut into stubs having substantially equal height. The sywack stubs are inserted into brush head 14 to assemble toothbrush 10. Often, the bark or shell of the sywack stubs near the distal end of the stubs is shaved to expose the fibers. The process of assembling toothbrush 10 will be described in more detail below. Brushing members 16*a*–16*c* can have any desirable height and in the present embodiment, the height of the brushing members is approximately 12 mm. The height of the locking member can be approximately 5 mm. When sywack is used as the brushing members, the diameter of a sywack is typically 5–10 mm. Of course, brush head 14 can be designed to accommodate brushing members having different diameters.

Figure 3:
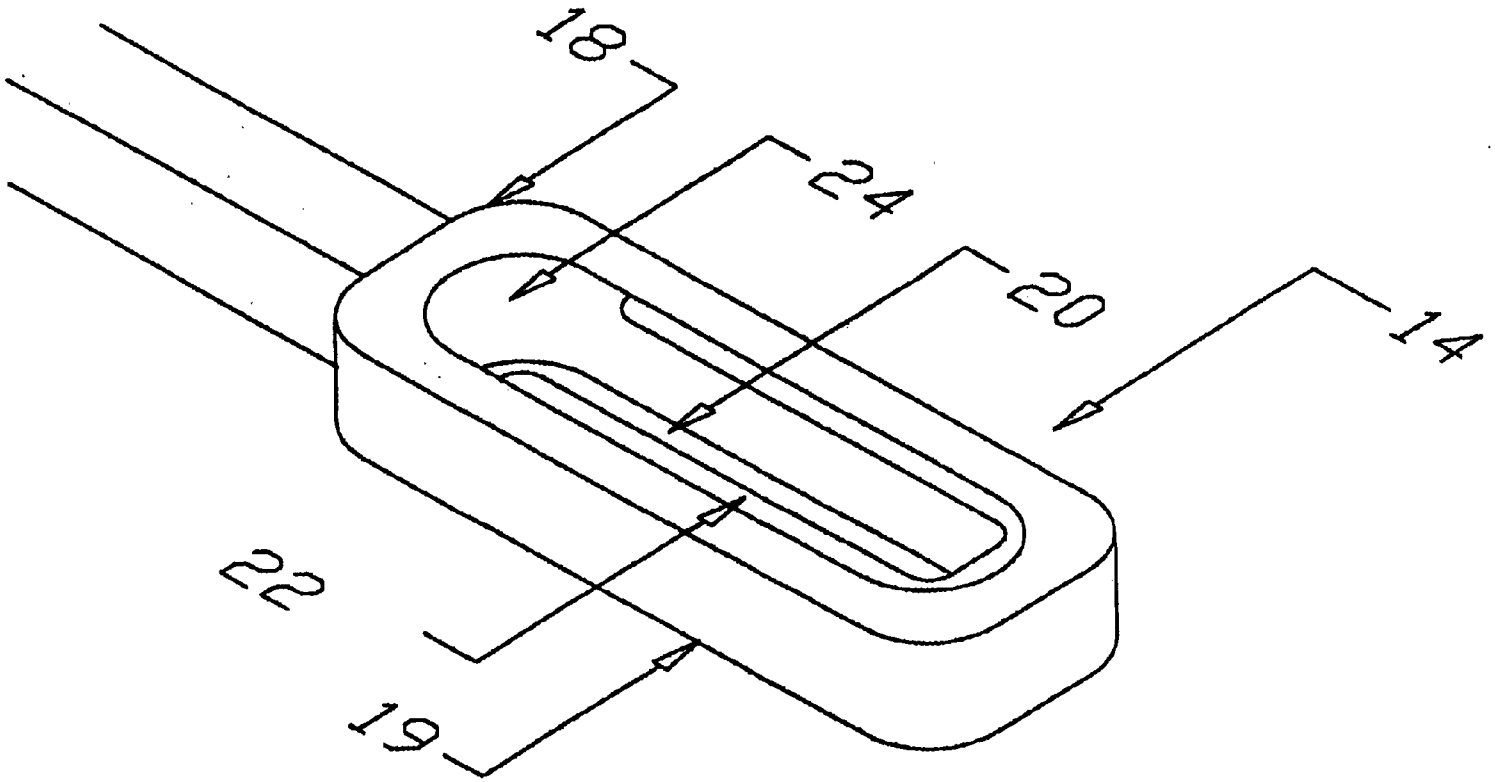
FIG. 3 is an enlarged perspective view of the brush head of the toothbrush of FIG. 1 according to one embodiment of the present invention.

FIG. 3 is a perspective view of brush head 14 of toothbrush 10 according to one embodiment of the present invention. In FIG. 3, brush head 14 is shown without any brushing members to illustrate the construction of the brush head in the present embodiment. Brush head 14 includes a body 18 and a bottom surface 19 defining a cavity 20 for accommodating one or more brushing members. In the present embodiment, brushing members 16*a*–16*c* are placed in cavity 20 against bottom surface 19 and are secured in the cavity of brush head 14 by a flange 22 formed around the inside perimeter of body 18, except at an opening 24 at the base of brush head 14. In accordance with the present embodiment, flange 22, functioning as an anchoring member, engages the outside surfaces of the brushing members, thereby anchoring and securing the brushing members in place. Specifically, when the brushing members are made of sywack, flange 22 presses against the sides of the sywack stubs to secure the sywack stubs in cavity 20. Opening 24 in brush head 14 is provided for inserting the brushing members before the brushing members are pushed towards flange 22 during the assembly process, as will be described in more detail below.

Figure 4:
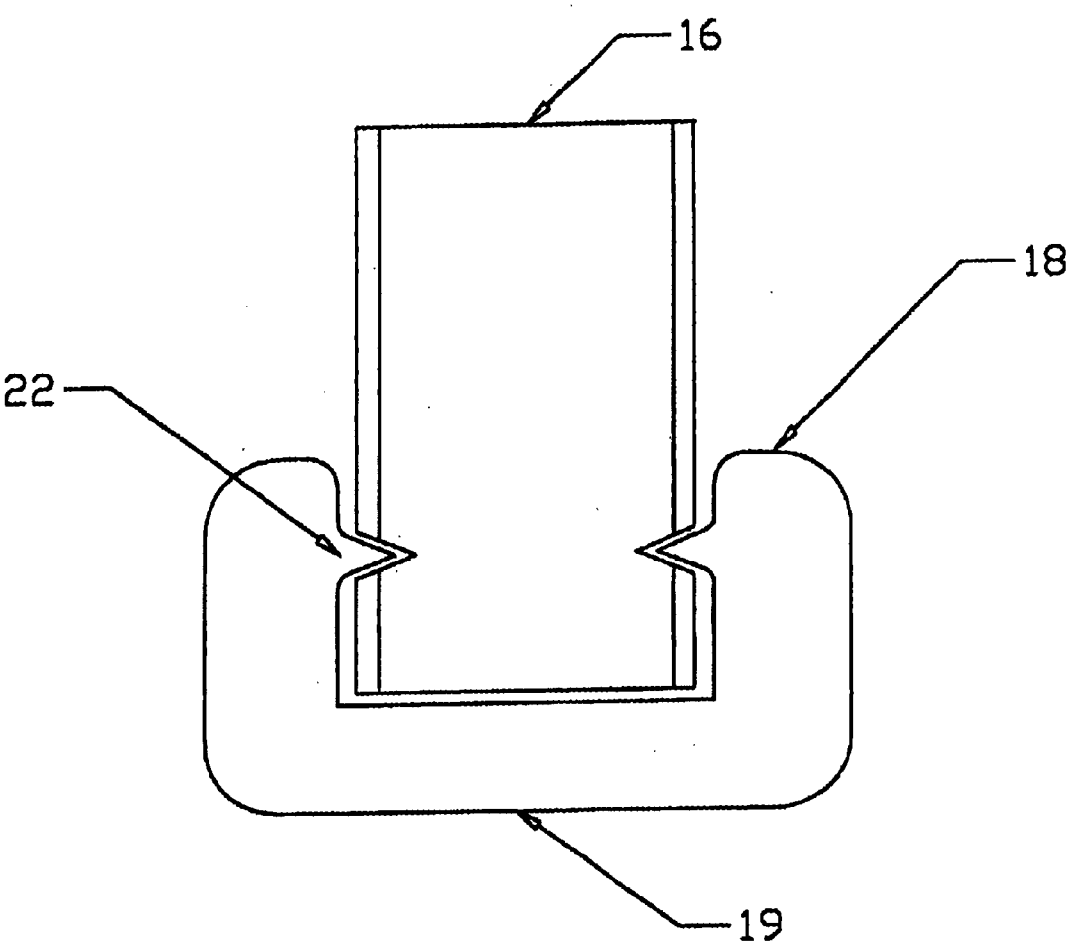
FIG. 4 is a cross-sectional view of the brush head of the toothbrush of FIG. 3 including a brushing member according to one embodiment of the present invention.

FIG. 4 is a cross-sectional view of brush head 14 according to one embodiment of the present invention. As shown in FIG. 4, flange 22, disposed around the inside perimeter of body 18, is provided with sufficient amount of protrusion such that flange 22 can bite into a brushing member 16 for securing the brushing member in the cavity. Typically, flange 22 is formed as a sharp notch or a sharp protrusion and is placed near the middle point along the height of body 18. Of course, the shape of flange 22 is not critical as long as it provides sufficient compressive force for anchoring the brushing members in place. In the present embodiment, flange 22 is used as the anchoring member to anchor the brushing members in cavity 20. However, one of ordinary skill in the art would appreciate that other anchoring mechanisms can be used for anchoring brushing members in the cavity of the brush head of the toothbrush of the present invention. For example, a spring-loaded mechanism around the inside perimeter of the brush head can be used to anchor the brushing members.

Handle 12 and brush head 14 of toothbrush 10 can be made of the same material or can be made of different materials. Typically, handle 12 and brush head 14 are made of a very hard wood or a conventional plastic material suitable for use in toothbrushes. When brush head 14 is made of wood, flange 22 can be formed in body 18. When brush head 14 is made of plastic, flange 22 can be formed using an injection molding process. Flange 22 needs to be made with a material rigid enough to press against the brushing members so as to secure the brushing members in place.

The process of assembling toothbrush 10 of the present invention will now be described with reference to FIGS. 5*a* to 5*i* and FIGS. 6*a* to 6*i*. FIGS. 5*a* to 5*i* illustrate the process of assembling the brushing members in brush head 14 of FIG. 3 according to one embodiment of the present invention. FIGS. 6*a* to 6*i* illustrate the same process from a top view of toothbrush 10. As described above, when sywack stubs are used in toothbrush 10 of the present invention, in preparing the brushing members for assembly, the bark or shell of the sywack stubs at the distal ends of the stubs is often shaved to expose the fibers of the sywack stubs.

Figures 5A, 5B, 5C, 5D, 5E, 5F, 5G, 5H, 5I:
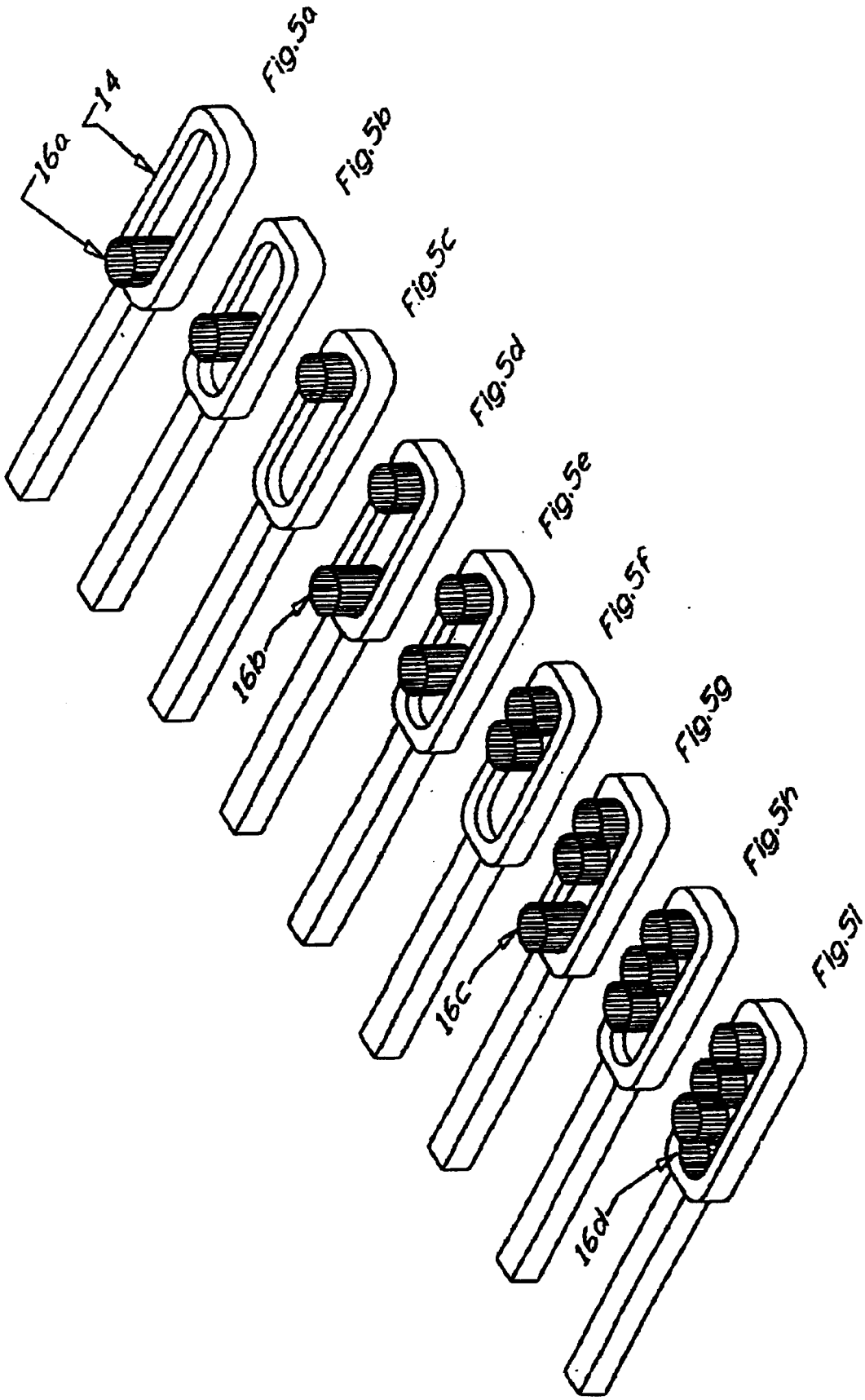
FIGS. 5*a*–5*i* illustrate the process of assembling the brushing members in the brush head of FIG. 3 according to one embodiment of the present invention.

Beginning with FIG. 5*a,* a user inserts the first brushing member (denoted member 16*a*) into cavity 20 of brush head 14 at opening 24. Because opening 24 is clear of any protrusion limiting the width of the opening, brushing member 16*a* can be easily inserted into cavity 20. Then, the user slides brushing member 16*a* down towards the top of cavity 20, allowing flange 22 to bite into the sides of brushing member 16*a* (FIG. 5*b*). The first brushing member is in place when it is slid to the top end of cavity 20 (FIG. 5*c*). Then, the user inserts a second brushing member (member 16*b*) at opening 24 as shown in FIG. 5*d*. Again, the user slides brushing member 16*b* towards the top end of cavity 20 (FIG. 5*e*) until the second brushing member is adjacent the first brushing member (FIG. 5*f*). Finally, the user inserts the last brushing member (member 16*c*) into opening 24 (FIG. 5*g*) and slides brushing member 16*c* towards the second brushing member 16*b* (FIG. 5*h*). In the present embodiment, brush head 14 is designed to accommodate three brushing members. Of course, the length of brush head 14 can be adjusted accordingly to accommodate any number of brushing members. Typically, one to three brushing members are desirable.

After all of the brushing members are in place, a locking member 16*d* is inserted into opening 24 to hold brushing members 16*a*–16*c* in place. In this manner, brushing members 16*a*–16*c* are secured in place and will not move when toothbrush 10 is used for cleaning teeth. In the present embodiment, locking member 16*d* is made of the same material as brushing members 16*a*–16*c* but is made with a shorter height than the brushing members. For example, when brushing members 16*a*–16*c* are sywack stubs, locking member 16*d* can be a sywack stub having reduced height. In an alternate embodiment, locking member 16*d* can have the same height as the brushing members and thus also functions as a brushing member.

Figures 6A, 6B, 6C, 6D, 6E, 6F, 6G, 6H, 6I:
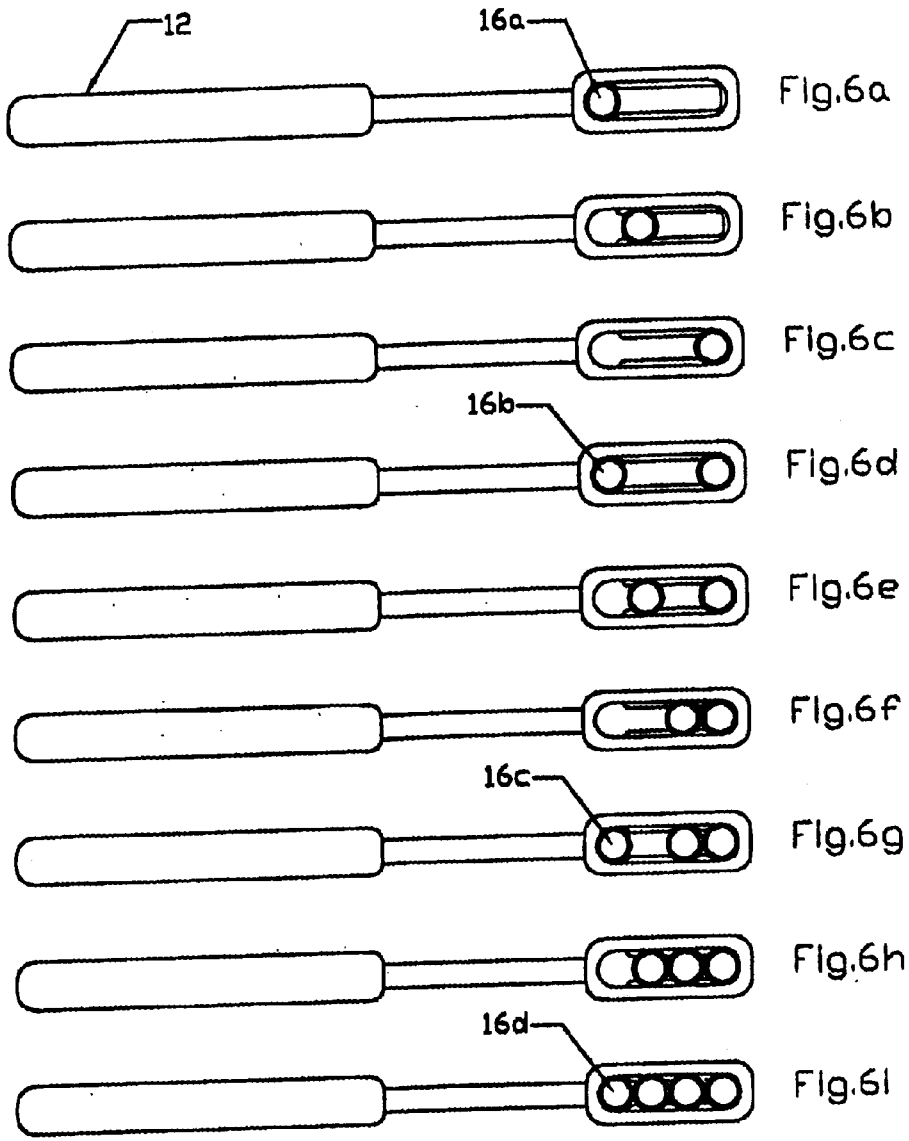
FIGS. 6*a*–6*i* is a top view of the toothbrush of the present invention illustrating the process of loading up to three pieces of sywack stubs into the brush head of the toothbrush.

When assembled as shown in FIGS. 5*i* and 6*i*, toothbrush 10 can then be used to clean the teeth of a user as in a conventional fashion. The user holds onto handle 12 and place the cleaning surfaces (the distal ends) of brushing members 16*a*–16*c* adjacent the surface of the teeth. By applying a sawing motion, toothbrush 10 can be used to clean all exposed surfaces of the teeth effectively, including the inside surface of the teeth and the top surface of the molars.

The toothbrush of the present invention is particularly useful in Middle Eastern countries such as Saudi Arabia and Egypt where sywack are traditionally used for teeth cleaning. By using sywack stubs as the brushing members, the toothbrush of the present invention preserves the traditional cleaning materials used in those countries while giving the users the ability to clean all surfaces of all teeth effectively. Thus, a user may use the toothbrush of the present invention assembled with sywack stubs as brushing members to clean the front and back surfaces of the front, side and back teeth (i.e., the incisors, the canines, the bicuspids and the molars). Furthermore, using the toothbrush of the present invention, the user can also apply the cleaning surfaces of the sywack stubs to the top surfaces of the molars for effectively cleaning of all surfaces of all teeth.

In typical applications, after assembly of the sywack stubs in toothbrush 10, toothbrush 10 can be immersed in water for about five minutes to rewet the sywack stubs. The rewetting process is particularly useful when the sywack stubs are made from dried sywack stick. The rewetting process makes the fibers in the sywack stubs tender and more flexible for the purpose of teeth cleaning.

Figure 12A:
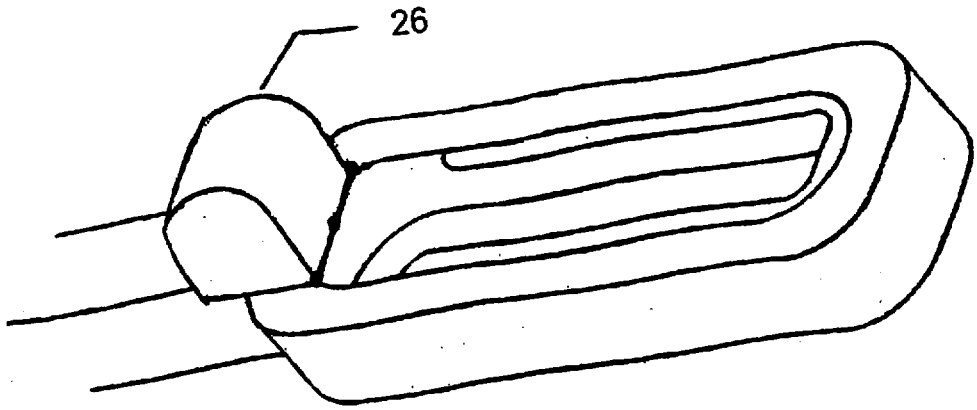
FIGS 12*a*–12*c* are perspective views of a toothbrush with removable brushing members and a hinged bar as looking member according to one embodiment of the present invention.
Figure 12B:
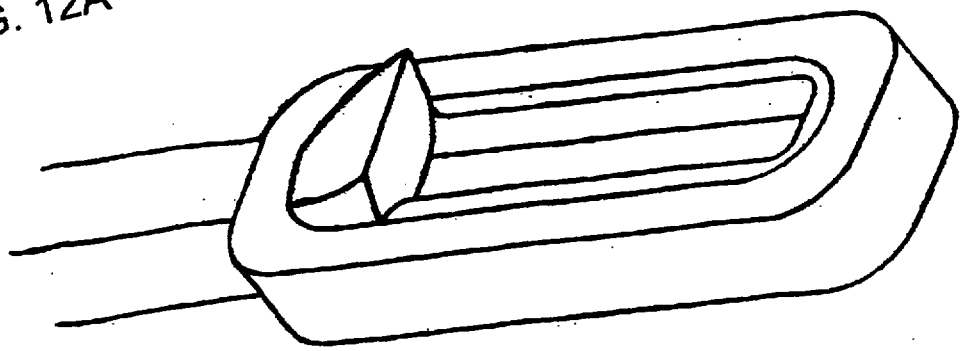
Figure 12C:
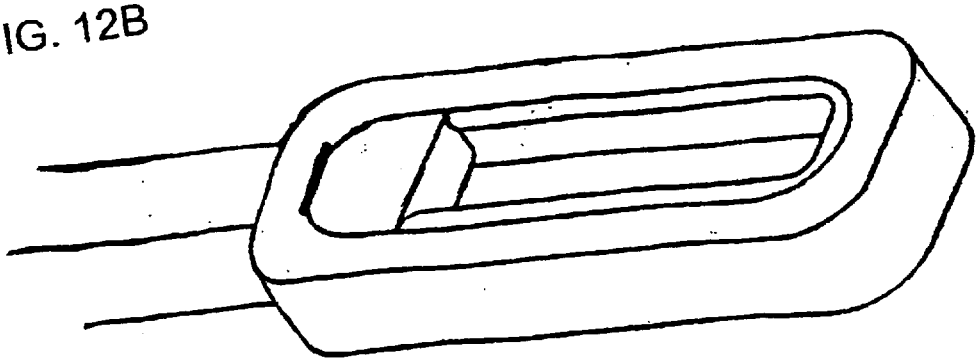

In the present embodiment, toothbrush 10 uses a locking member 16*d* to hold brushing members 16*a*–16*c* affixed in cavity 20. In an alternate embodiment of the present invention, a hinged bar or a brace or other locking mechanism can be used to retain the brushing members in plane. For example, a hinged bar 26 can be placed at the base of cavity 20 and is forced down in place against the last brushing members in cavity 20, as shown in FIGS. 12*a*–12*c*. Alternately, a brace can be used to retain the brushing members in place. One of ordinary skill in the art would appreciate that a number of locking mechanisms can be used to secure the brushing members in toothbrush 10 of the present invention. In one embodiment, toothbrush 10 can be made with only one brushing member and without a locking member. The brushing member can be held in place by the flange in the brush head or by other suitable locking mechanism.

Figure 7:
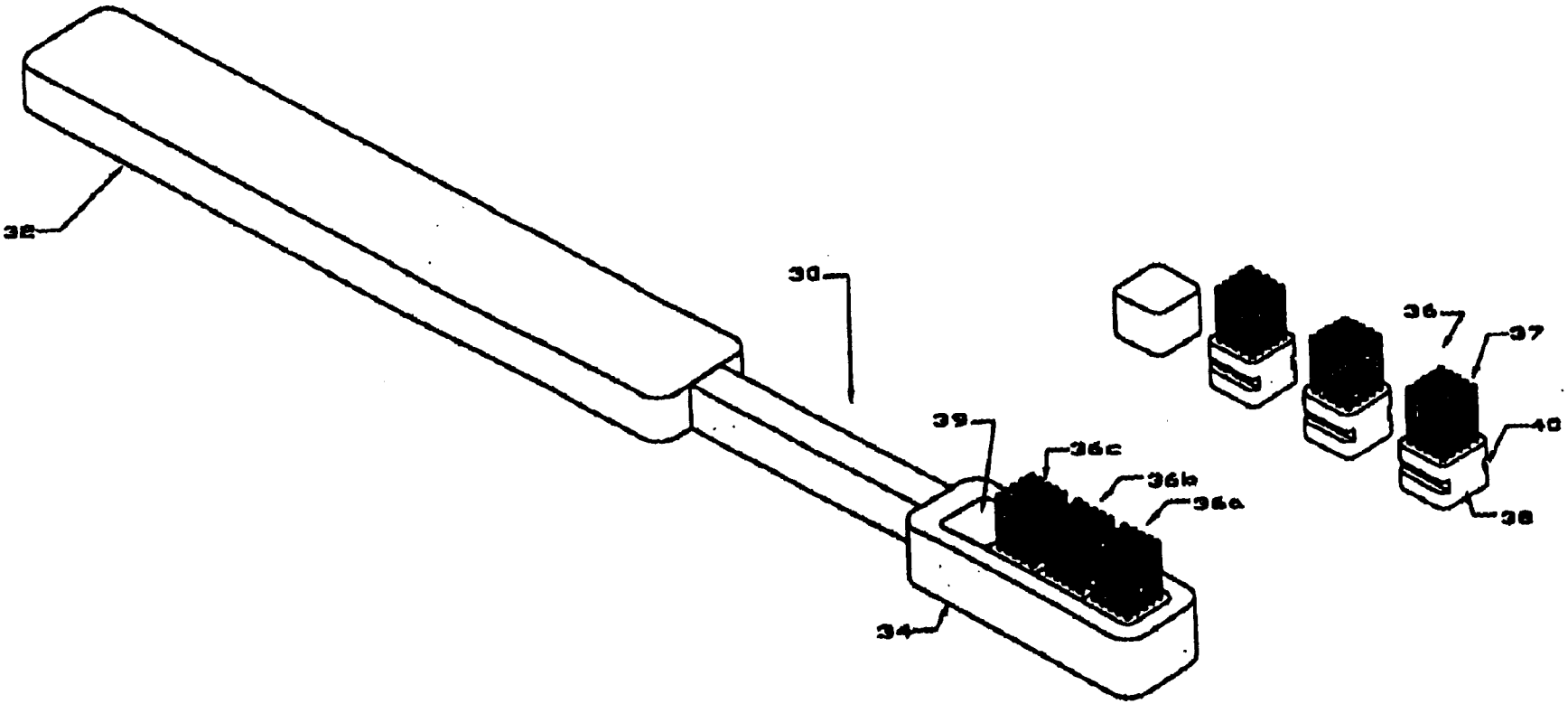
FIG. 7 is a perspective view of a toothbrush with removable brushing members according to one embodiment of the present invention.
Figure 8:
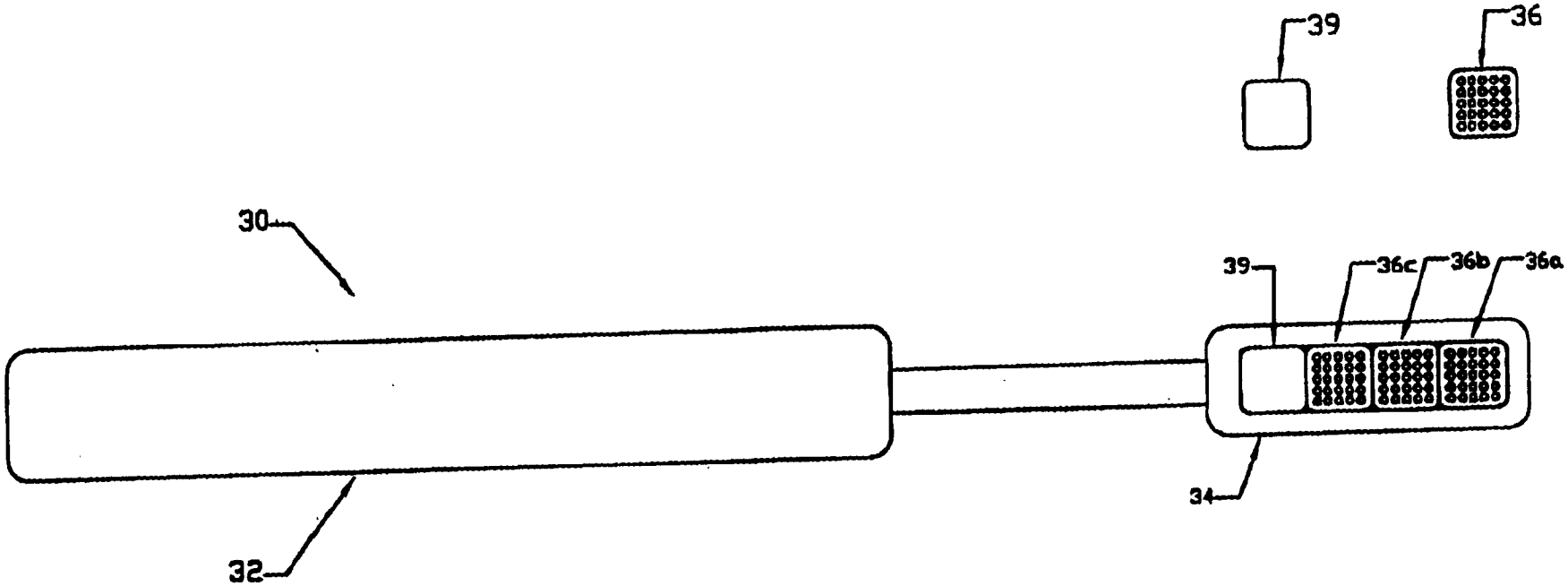
FIG. 8 is a top view of the toothbrush of FIG. 7.

FIGS. 7–10 illustrate another embodiment of the present invention where the brushing members are made of nylon filaments. FIG. 7 is a perspective view of toothbrush 30 including removable brushing members 36*a* to 36*c* while FIG. 8 is a top view of toothbrush 30. Brushing member 36 represents any one of brushing members 36*a* to 36*c* and includes a base 38 and multiple bristle tufts 37 extending from base 38. The bristle tufts are typically made of nylon filaments or other conventional material used in making bristles for toothbrushes. Toothbrush 30 may include one or more brushing members. In toothbrush 30, a locking member 39 is included for holding brushing members 36*a* to 36*c* affixed in the cavity of brush head 34. As shown in FIGS. 7 and 8, locking member 39 can be made of the same material and can be of the same size as base 38 of brushing member 36.

Figure 9:
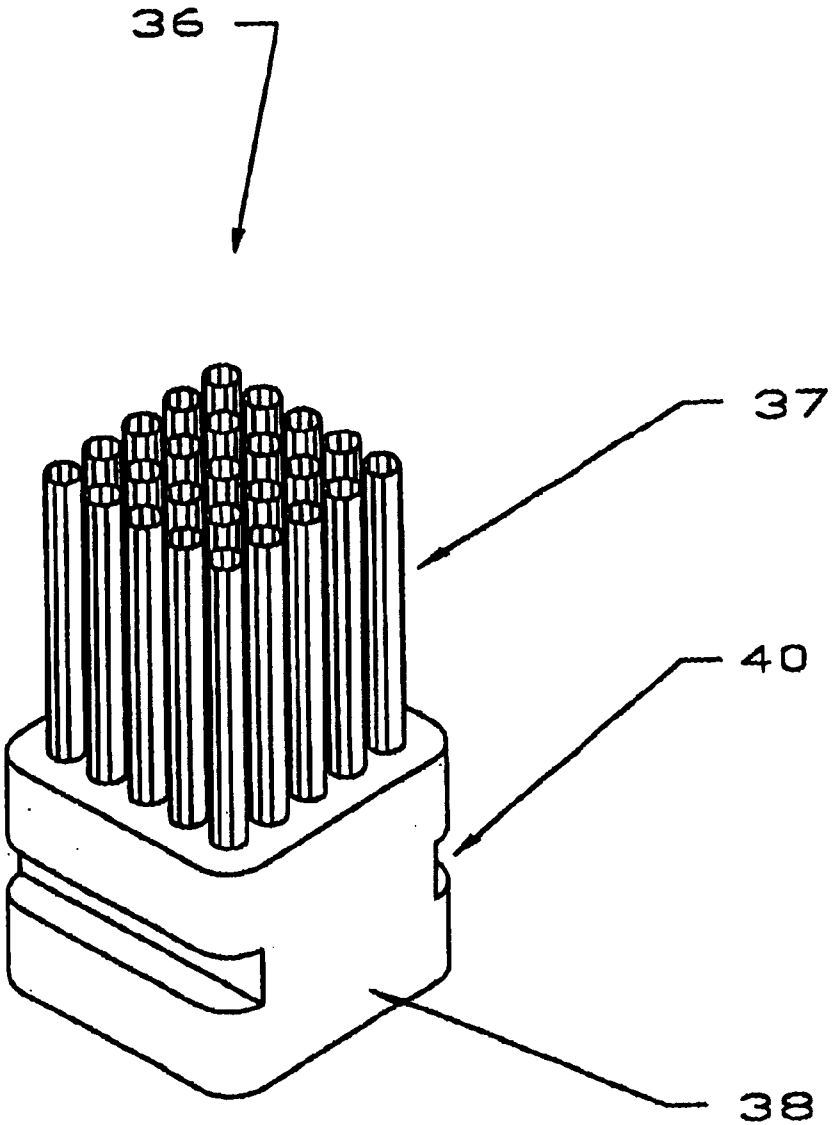
FIG. 9 is an enlarged perspective view of a brushing member used in the toothbrush of FIG. 7.
Figure 10:
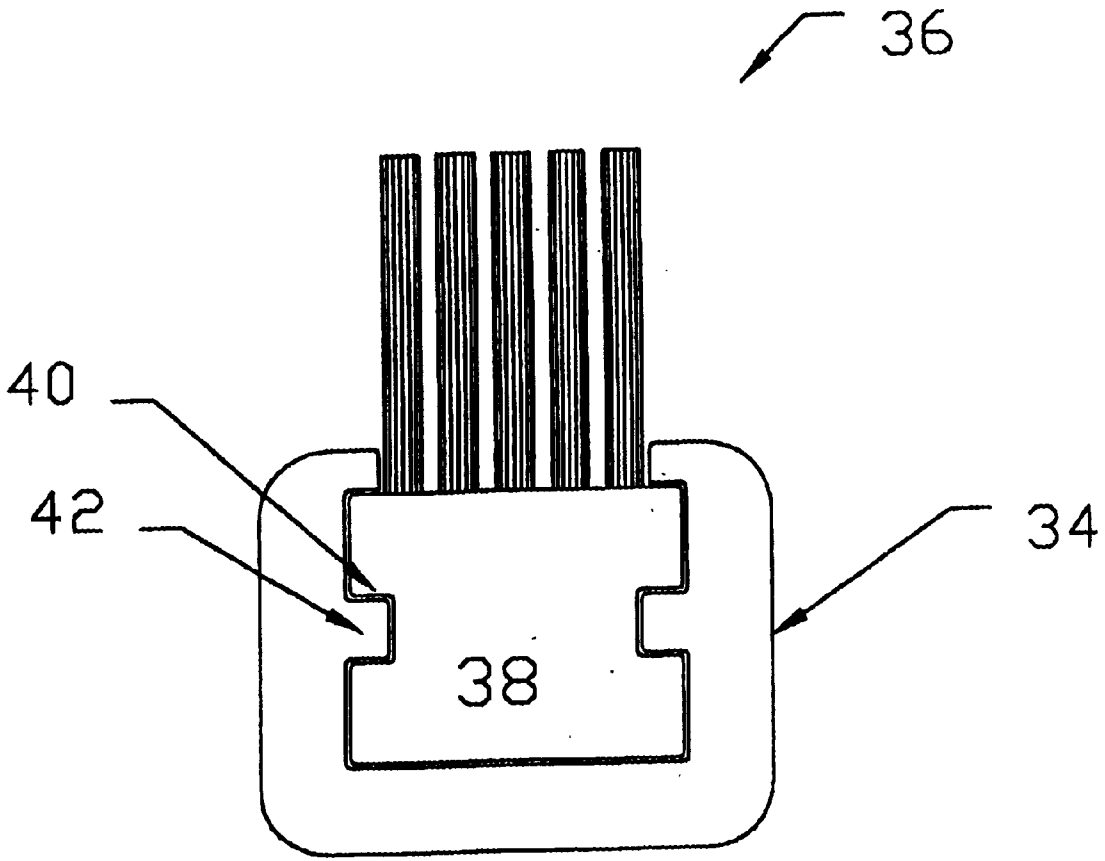
FIG. 10 is a cross-sectional view of the brush head of FIG. 7 including a brushing member according to one embodiment of the present invention.

FIG. 9 is an enlarged perspective view of brushing member 36 used in toothbrush 30 of FIG. 7. In the present embodiment, brushing member 36 is shown as including a square of 36 tufts of nylon filament bristles. The tufts are spaced apart at a suitable distance to provide effective cleaning capability. Base 38 of brushing member 36 can be made in wood or plastic or other conventional material rigid enough to secure bristle tufts 37. In the embodiment shown in FIG. 9, base 38 includes a groove 40 for engaging the anchoring member, such as a flange, around the perimeter of brush head 34. FIG. 10 is a cross-sectional view of brush head 34 including a brushing member 36. Groove 40 of base 38 is disposed to engage flange 42 of brush head 34 for anchoring brushing member 36 in place.

Figure 11:
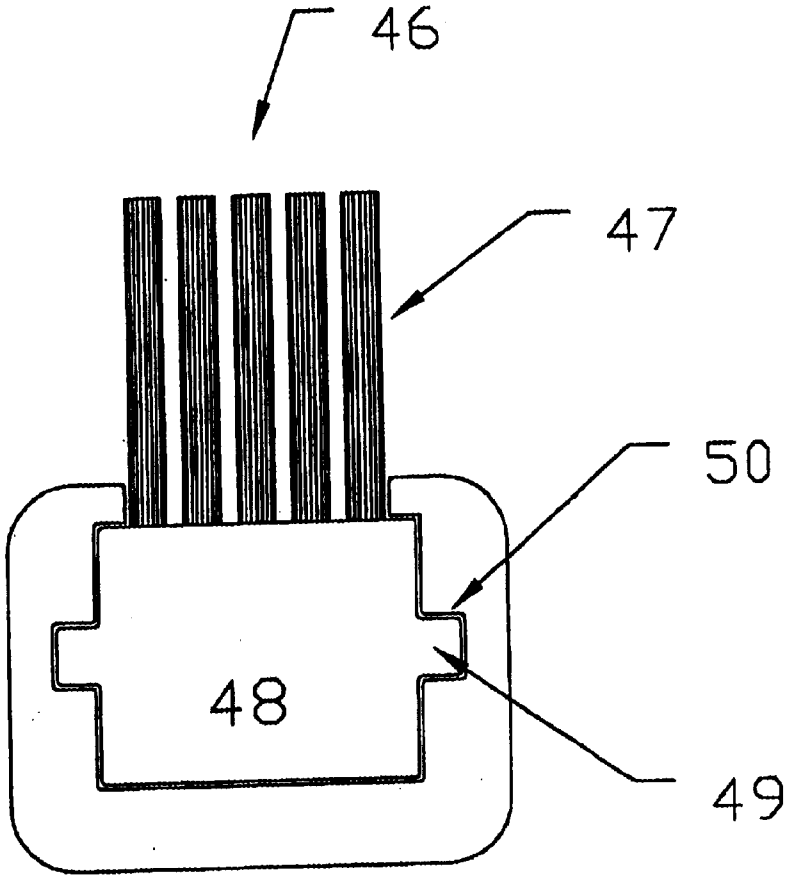
FIG. 11 is a cross-sectional view of the brush head of FIG. 7 including a brushing member according to another embodiment of the present invention.

FIG. 11 illustrates another embodiment a toothbrush of the present invention. In the embodiment shown in FIG. 11, brushing member 46 is similar in construction to brushing member 36 and includes multiple bristle tufts 47 and a base 48. However, in the present embodiment, base 48 of brushing member 46 includes a protusion or a flange 49 along the sides of the base which is provided to engage with a groove 50 provided in brush head of the toothbrush. In this manner, brushing member 46 can be anchored in place by fitting flange 49 into groove 50 of the brush head.

In the present embodiment, toothbrush 30 uses locking member 39 for holding brushing members 36*a*–36*c* in place. In other embodiments, locking member 39 is not needed and brush head 34 can include other means for locking the brushing members in place. In an alternate embodiment, a spring loaded notch is provided at the base of brush head 34. The brushing members are snapped in place by being forced downward into the cavity 20 through the notch. In yet another alternate embodiment, a resilient metal lever can be provided at the base of brush head 34 and the brushing members are snapped into the cavity of the brush head, after which the metal lever springs back in shape, holding the brushing members affixed in the cavity of the brush head.

Figure 13:
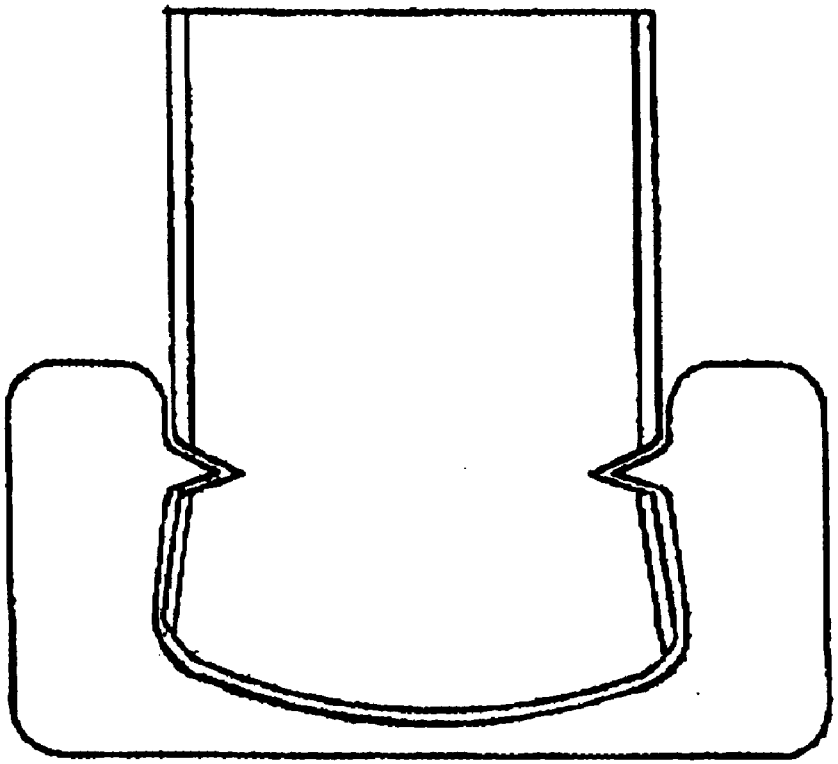
FIG. 13 is a cross-sectional view of the brush head of a toothbrush including a concave bottom surface according to one embodiment of to present invention.

The above detailed descriptions are provided to illustrate specific embodiments of the present invention and are not intended to be limiting. Numerous modifications and variations within the scope of the present invention are possible. For example, the bottom surface of the brush head can be shaped suitably, such as curved in a concave shape as shown in FIG. 13, for securing the brushing members. The present invention is defined by the appended claims.

We claim:

1. A toothbrush comprising:

a handle;

a brush head extending from said handle, said brush head comprising a bottom surface and a body together defining a cavity for receiving a first brushing member, and an anchoring member extending around the inside perimeter of said body except at a first end of the inside perimeter of said body; and said first brushing member comprising a soft wood, wherein said first brushing member is inserted into said cavity at said first end and is slid along said cavity into said anchoring member, said anchoring member compressing against and biting into the sides of said first brushing member to secure said first brushing member in said cavity.

2. The toothbrush of claim 1, wherein said soft wood comprises siwak.

3. The toothbrush of claim 1, further comprising a locking member, said locking member being inserted into said cavity at said first end for holding said first brushing member affixed in said cavity.

4. The toothbrush of claim 3, wherein said locking member comprises a soft wood.

5. The toothbrush of claim 3, wherein said locking member has a height shorter than the height of said first brushing member.

6. The toothbrush of claim 1, further comprising:

a hinged bar at said first end of said cavity, said hinged bar being forced towards said bottom surface of said brush head to press against said first brushing member and thereby holding said first brushing member affixed in said cavity.

7. The toothbrush of claim 1, wherein said handle and said brush head are made of a material selected from the group consisting of hard wood and plastic.

8. The toothbrush of claim 1, wherein said first brushing member comprises a plurality of brushing members, said cavity of said brush head having a first length for accommodating said plurality of brushing members arranged linearly along said first length.

9. The toothbrush of claim 1, wherein said anchoring member comprises a flange.

10. The toothbrush of claim 9, wherein said body has a first height and said flange comprises a protrusion formed midway in said first height along said inside perimeter of said body.

11. The toothbrush of claim 9, wherein said flange extends along said inside perimeter of said body except at said first end at a base of said brush head, said first end being of sufficient size to permit the insertion of said first brushing member.

12. The toothbrush of claim 9, wherein said flange provides compressive force for anchoring said first brushing member in said cavity.

13. The toothbrush of claim 1, wherein said bottom surface is curved in a concave shape.

14. A toothbrush comprising:

a handle;

a brush head extending from said handle, said brush head comprising a bottom surface and a body together defining a cavity for receiving a plurality of brushing members, and an anchoring member extending around the inside perimeter of said body except at a first end of the inside perimeter of said body; and said plurality of brushing members each comprising a soft wood, wherein each of said plurality of brushing members is inserted into said cavity at said first end and is slid along said cavity into said anchoring member, said anchoring member compressing against and biting into the sides of said plurality of brushing members to secure said plurality of brushing members in said cavity.

15. The toothbrush of claim 14, wherein said soft wood comprises siwak.

16. The toothbrush of claim 14, further comprising a locking member, said locking member being inserted into said cavity at said first end for holding said plurality of brushing members affixed in said cavity.

17. The toothbrush of claim 16, wherein said locking member comprises a soft wood.

18. The toothbrush of claim 16, wherein said locking member has a height shorter than the height of said plurality of brushing members.

19. The toothbrush of claim 14, further comprising:

a hinged bar at said first end of said cavity, said hinged bar being forced towards said bottom surface of said brush head to press against a last of said plurality of brushing members and thereby holding said plurality of brushing members affixed in said cavity.

20. The toothbrush of claim 14, wherein said handle and said brush head are made of a material selected from the group consisting of hard wood and plastic.

21. The toothbrush of claim 14, wherein said anchoring member comprises a flange providing compressive force for anchoring said plurality of brushing members in said cavity.

22. The toothbrush of claim 21, wherein said body has a first height and said flange comprises a protrusion formed midway in said first height along said inside perimeter of said body.

* * * * *